United States Patent [19]

Simonds et al.

[11] 4,372,285

[45] Feb. 8, 1983

[54] ADJUSTABLE CABLE END BRACKET FOR COMPOUND BOW

[75] Inventors: Gary Simonds, Gainesville, Fla.; Arnold D. McKee, Hartford, Ill.

[73] Assignee: Victor United, Inc., Chicago, Ill.

[21] Appl. No.: 248,976

[22] Filed: Mar. 30, 1981

[51] Int. Cl.[3] ..... F41B 5/00

[52] U.S. Cl. ..... 124/90; 403/110; 124/DIG. 1

[58] Field of Search ..... 124/23 R, 24 R, 25, 124/90, 86, 1, DIG. 1; 403/4, 393, 388; 248/222.4, 223.1, 223.2

[56] References Cited

U.S. PATENT DOCUMENTS

| | | | |
|---|---|---|---|
| 3,071,400 | 1/1963 | Bellock | 248/223.2 X |
| 3,486,495 | 12/1969 | Allen | 124/24 |
| 3,967,609 | 7/1976 | Frydenlund | 124/24 R |
| 4,079,722 | 3/1978 | Griggs | 124/90 X |
| 4,252,456 | 2/1981 | Kallaes et al. | 403/393 |
| 4,336,786 | 6/1982 | Mannon et al. | 124/23 R |

*Primary Examiner*—Richard C. Pinkham
*Assistant Examiner*—William R. Browne
*Attorney, Agent, or Firm*—Emory L. Groff, Jr.

[57] ABSTRACT

The ends of a compound bow tension cable are positively and adjustably anchored by an attachment bracket pivotally mounted upon the bow limb tips adjacent the eccentric wheels. The attachment bracket includes two somewhat similar components, elongated in nature, with one component pivotally attached relative the bow limb tip and the other component having a tension cable end fixed thereto. The two components are assembled in an overlapping arrangement with the juxtaposed faces thereof provided with mating adjustment elements such as transversely disposed teeth or serrations whereupon after selecting the appropriate relative longitudinal relationship between the two components, a releasable fastener is tightened to retain the mating adjustment elements in a fixed disposition insuring a rigid bracket member maintaining the selected tension upon the attached cable end.

4 Claims, 3 Drawing Figures

ADJUSTABLE CABLE END BRACKET FOR COMPOUND BOW

This invention relates generally to archery bows and more particularly, to an improved attachment bracket for securing the ends of the bow tension cables in a compound bow.

As is well known to those skilled in the art, the most popular form of compound bow includes two or more eccentrically mounted pulleys or wheels pivotally attached relative the bow limbs and serving to support and control the movement of a bow string which in turn is connected to a tension cable. Means must be provided to suitably anchor the two free ends of this tension cable and a common method theretofore utilized has involved merely looping each cable end about the pivot shaft supporting the wheels and thereafter retaining the loop by means of fixed fastener means such as a crimped metal sleeve. Another prior effort includes the attachment of the cable ends to a suitable fastener component affixed to the bow limb at a point removed from the eccentric pivot shafts. Both of these earlier solutions fall far short of providing the ideal arrangement inasmuch as each method is substantially a permanent installation since any subsequent adjustment of the tension cable attachment involves a relatively major operation not very readily accomplished in the field and more importantly, fails to provide any means for obtaining a precision adjustment of the two free ends of the tension cable.

As will be appreciated by those familar with compound bows, the stringing or outfitting of such a bow with its tension cable and bow string is very critical in order to achieve a proper balance or synchronization of the eccentrically mounted wheels. By the present invention, an improved tension cable end attachment bracket is provided which may be readily used by an archer, even in the field, and which allows for the quick attachment and subsequent adjustment or fine tuning of either or both tension cable ends with the result that an accurate, positive and secure anchoring of the tension cable ends is achieved.

The instant adjustable attachment bracket includes an elongated bow plate pivotally attached to the same shaft supporting the eccentric pulley and which cooperates with a substantially similarly configured elongated cable plate to which the tension cable end is affixed. The two plates are employed in an overlapping arrangement with mating adjustment means, such as transversely disposed teeth, provided on the opposed faces of the two plates such that upon clamping of the plates together by means of a releasable fastener, a selected axial length of the bracket is positively retained. Variation of the axial length of the bracket is readily accomplished in the field by merely loosening a fastener to disengage the mating teeth and thereafter collapsing or extending one of the plates relative the other plate prior to re-tightening of the fastener to secure the bracket in its altered length.

Accordingly, one of the objects of the present invention is to provide an improved adjustable cable end bracket for compound bows including a pair of substantially similar plates adapted to be clamped in an overlapping arrangement and retained by means of meshing transverse teeth provided on their opposed faces.

Another object of the present invention is to provide an improved adjustable cable end bracket for compound bows including a bow plate pivotally supported adjacent a bow limb tip and cooperating with a cable plate to which an end of a tension cable is fixed with releasable fastener means securing the two plates in any one of a plurality of positively secured axial lengths.

Still another object of the present invention is to provide an improved adjustable cable end bracket for compound bows including overlapping plates attached respectively to a bow limb tip and tension cable end with mating serrations on opposed faces of the plates precluding alteration of the axial extent of the plates when clamped together by means of fastener components carried by the two plates.

With these and other objects in view which will more readily appear as the nature of the invention is better understood, the invention consists of the novel construction, combination and arrangement of parts hereinafter more fully described, illustrated and claimed.

Similar reference characters designate corresponding parts throughout the several figures of the drawing.

Figure 1:
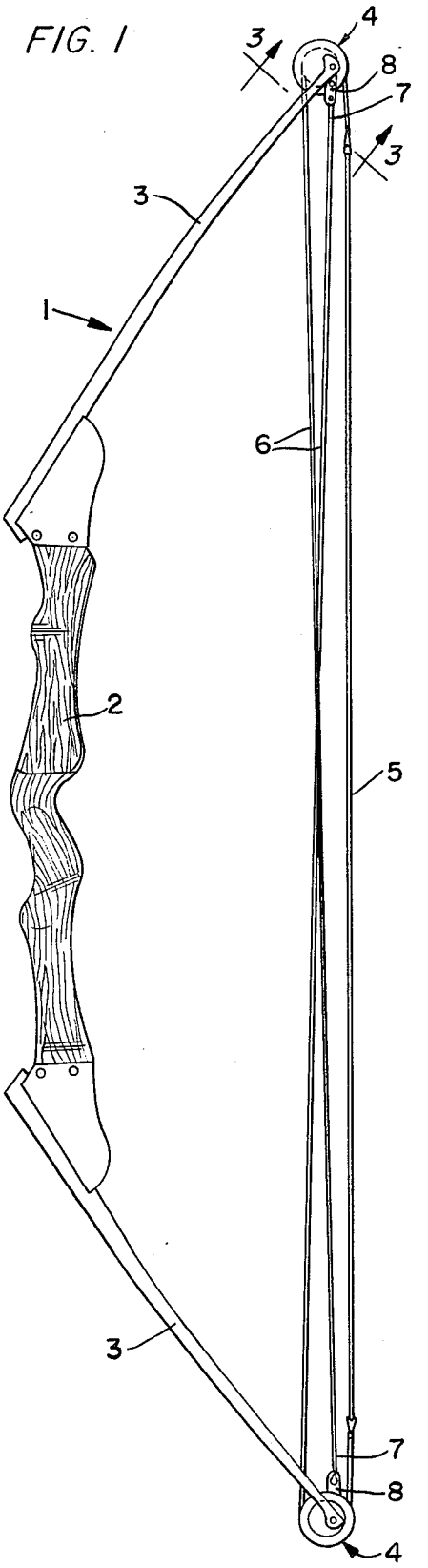
FIG. 1 is a side elevation of a typical compound bow incorporating the adjustable cable end bracket of the present invention.

Referring now to the drawing, particularly FIG. 1, the present invention will be understood to relate especially to a compound bow, an example of which is generally designated 1 and includes a central handle 2 joined to a pair of resilient limbs 3—3 extending therefrom. Mounted adjacent the distal portion of each tip of the bow limbs 3 is an eccentric wheel or pulley 4. Cooperating with the two pulleys 4—4 is a bow string 5 centrally disposed with respect to an attached tension cable 6. The two free ends 7—7 of this cable 6 must be suitably anchored with respect to the bow limbs 3 and this function is performed by means of the bracket 8 according to the present invention.

It will be appreciated that the cable end bracket herein proposed may be utilized in combination with numerous types of archery bows and therefore the specific bow 1 as illustrated in FIG. 1 will be considered merely exemplary inasmuch as the essence of the invention resides in the unique construction of the bracket 8 which is used to adjustably secure each of the two tension cable free ends 7—7 with respect to the two adjacent bow limb tips.

Figure 3:
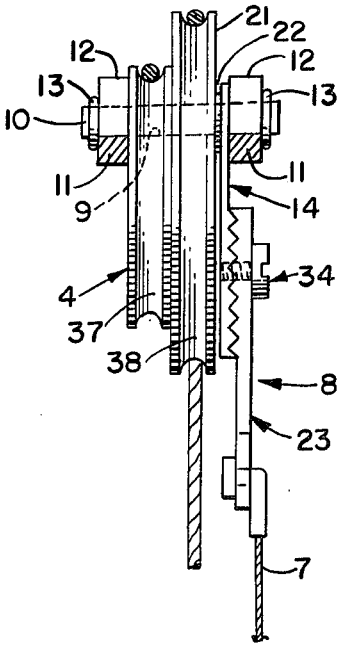
FIG. 3 is a transverse section taken along the line 3—3 of FIG. 1

In the bow example of FIGS. 1 and 3 of the drawing, the wheels or pulleys 4 each include an eccentrically disposed bore 9 for receiving a pivot pin or shaft 10. In this instance, the pulleys 4 are disposed between the split limb tips 11 which tips include an enlargement 12 for the reception of the transversely disposed pivot shaft 10 which is secured in the assembled position of FIG. 3 by means of suitable retainer members 13. Numerous alternate mounting means for the pulleys may be employed as is well known in the art. On such example of an alternative mounting includes the attachment of a separate U-shaped bracket to the limb tips, which bracket serves to transversely support the eccentric pivot shaft 10.

Regardless of the type of mounting provided for the bow eccentric wheels, it is considered most advantageous to anchor the tension cable ends 7—7 as close to the pivot shaft 10 as possible. Accordingly, it is proposed to utilize this same pivot shaft 10 for mounting of the present bracket 8. This bracket includes an elongated bow plate 14 having an inside face 15 and outside face 16 bounded at opposite ends by an outer edge 17 and inner edge 18. Bow mounting means in the form of a transverse pivot bore 19 is formed through the bow plate 14 adjacent its outer edge 17 and is configured to provide a close sliding fit about the periphery of the pivot shaft 10.

Substantially half of the inside face 15 adjacent to the outer edge 17 is preferably planar while the remaining one-half of the inside face adjacent the inner edge 18 is provided with adjustment means comprising a plurality of transversely disposed teeth or serrations 20 all of which are of similar configuration for reasons which will become obvious hereinafter. This bow plate 15 is adapted to be mounted upon the eccentric pivot shaft 10 preferably with its outside face 16 juxtaposed one side 21 of each pulley 4. In this regard, an appropriate flat washer 22 may be disposed between the two aforementioned components to preclude interference therebetween.

Cooperating with the bow plate 14 is an elongated cable plate 23, the overall configuration of which is substantially similar to that of the bow plate 14. This feature facilitates the manufacture of the bracket 8 since the two plates 14 and 23 may be finalized by utilizing two identical plates. The cable plate 23 includes an inside face 24 and an outside face 25 bounded by an opposite inner edge 26 and outer edge 27. As in the case of the bow plate 14, the cable plate inside face 24 is substantially planar along that half of its surface adjacent the outer edge 17 while the remainder of the inside face 24 is provided with adjustment means comprising transversely disposed teeth or serrations 28 which are configured to provide a close mating fit with the similar teeth or adjustment means 20 of the bow plate 14.

Figure 2:
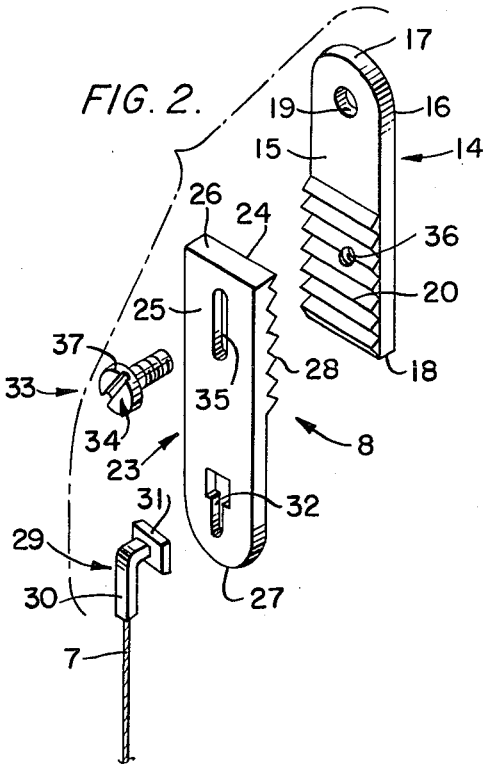
FIG. 2 is an enlarged exploded view of one of the brackets shown in FIG. 1.

While the bow plate 14 is designed to remain supported with respect to the tips of the bow limb 3 by means of its pivot bore 19, the cable plate 23 on the other hand, is intended to engage and retain a tension cable end 7. This engagement may be accomplished through any suitable means and FIG. 2 of the drawing illustrates a feasible arrangement wherein the cable end 7 is provided with an end fixture 29 having a base 30 firmly anchored to the cable end and joined to an enlarged head 31 configured to cooperate with cable end connection means 32 on the cable plate 23. This connecting means may include the illustrated key opening 32 adapted to receive the head 31 and to retain the same as the cable end 7 is moved toward the cable plate outer edge 27.

Adjustment of the tension cable ends 7 will be understood to be a simple matter of selecting the relative axial displacement between the two plates 14 and 23 of the bracket 8 whereafter the opposed mating adjustment means 20 and 28 of the two plates are intermeshed into the position as shown most clearly in FIG. 3 of the drawing. The juxtaposed bracket plates 14,23 are secure in the assembled position by means of appropriate adjustment retaining means 33 including a releasable fastener 34 loosely disposed through the slot 35 in the cable plate 23 and engageable within the tapped bore 36 provided in the bow plate 14. By using a screw 34 having a flattened or pan head 37, the side profile of the assembled bracket 8 is reduced and quite obviously the profile could be further reduced by providing a counterbore (not shown) about the perimeter of the vertical elongated slot 35. The tapped bore 36 is preferably located in the medial portion of the vertically extent of the plurality of teeth 20 on the bow plate 14 and this feature, combined with a sufficient vertical extent to the slot 35 in the cable plate 23, insures a maximum range of adjustment in the available axial length of the bracket 8.

The assembled position of FIG. 3 of the drawing illustrates the two plates 14 and 23 as they would appear when secured in the medial portion of their range that is, the cable plate 23 can be alternately located to either substantially shorten or substantially lengthen its overall axial extent from the position as shown in this figure.

As previously mentioned, the specific configuration of the bow limbs and pulleys is optional. In the drawing figures, a two-track pulley 4 is shown having the adjacently disposed small diameter groove 37 and large diameter groove 38. As is well known to those familiar with the art, with this arrangement, the tension cable leaving the ends of the bow string 5 passes through or crosses over (not shown) to the smaller diameter groove 37 whereafter the tension cable 6 passes through the bracket 8 located adjacent the opposite bow limb 2. Various alternative eccentric pulley arrangements may be utilized in combination with the bracket 8 of the present invention. Additionally, the bracket 8 as shown in FIG. 3 of the drawing, may be mounted in a reverse disposition that is, with the cable plate 23 disposed inwardly of the bow plate 14 so as to locate the attached cable end 7 closer to the bow center-line. In this manner of disposition the portion of the bow plate 14 adjacent the outer edge 17 would, of course be lengthened to insure clearance of the cable plate inner edge beyond the pulley periphery.

We claim:

1. In a compound archery bow having wheel assemblies eccentrically mounted upon pivot pins disposed adjacent each of two bow limb tips, a bowstring spanning said two wheel assemblies, a tension cable passing around each said wheel assembly and having a free end provided with an end fixture adjustably attached adjacent and opposite said wheel assembly; the improvement comprising, a cable end attachment bracket mounted upon at least one said pivot pin, said bracket including, separate elongated bow cable plates each having inside faces at least partially overlapping one another and each having oppositely directed outside faces, opposite inner and outer edges on each said plate, of said bow plates provided with mounting means adjacent its outer edge engageable with said pivot pin adjacent one said wheel assembly, said mounting means including a pivot bore extending through said bow plate outside and inside faces, said cable plate having cable end connecting means adjacent said cable plate outer edge receiving one said tension cable end, said cable plate connecting means including a key opening extending through said cable plate outside and inside faces, said key opening receiving the end of said cable end fixture, mating adjustment means on said overlapping inside faces selectively engageable to define the axial length of said bracket between said bow plate mounting means and said cable plate connecting means, releasable retaining means operable to clamp said mating adjustment means together to fixedly maintain said selected bracket axial length and said mating adjustment means comprising a plurality of teeth on said cable and bow plate inside faces adjacent said inner edges and extending transversely of the axial extent of said plates.

2. In a compound archery bow according to claim 1 wherein, said releasable retaining means includes a slot through one of said plates and a tapped bore in the other one of said plates, and a threaded fastener disposed through said slot and into said bore.

3. In a compound archery bow according to claim 2 wherein, said slot and tapped bore extend through said teeth.

4. In a compound archery bow according to claim 2 wherein, said slot extends axially of said elongated plate.

* * * * *